United States Patent [19]

Nishiguchi

[11] Patent Number: 4,754,508

[45] Date of Patent: Jul. 5, 1988

[54] INVALID BED

[76] Inventor: Hidetsugu Nishiguchi, c/o Maruni Co., Ltd., 9-34, Fukiage 2-chome, Ise-city, Mie 516, Japan

[21] Appl. No.: 132,252

[22] Filed: Dec. 14, 1987

[30] Foreign Application Priority Data

Sep. 7, 1987 [JP] Japan ..... 62-137346[U]

[51] Int. Cl.[4] ..... A61G 7/02

[52] U.S. Cl. ..... 5/90; 4/461; 4/585

[58] Field of Search ..... 5/90, 463, 67; 4/461, 4/451, 557, 585

[56] References Cited

U.S. PATENT DOCUMENTS 1,525,605 2/1925 Dry ..... 5/90
2,483,612 10/1949 Beem ..... 5/90
3,345,652 10/1967 Sadaji Hiraga ..... 5/90
4,030,149 6/1977 Kato ..... 5/90
4,085,472 4/1978 Dimatteo ..... 5/90
4,571,759 2/1986 Sasaki et al. ..... 5/90
4,631,762 12/1986 Fugett ..... 5/90

FOREIGN PATENT DOCUMENTS 8605972 10/1986 World Int. Prop. O. ..... 5/90

*Primary Examiner*—Alexander Grosz
*Assistant Examiner*—Eric K. Nicholson
*Attorney, Agent, or Firm*—Yusuke Takeuchi

[57] ABSTRACT

An invalid bed has a bedstead, a mattress support mounted on the bedstead, a mattress placed on the mattress support, a bedpan movable between a horizontal position and a tilted position, a rotary table pivoted to the bedstead, a number of containers mounted on the rotary table, a rotation device for rotating the rotary table, and a sealing device for sealing the opening of the container.

1 Claim, 4 Drawing Sheets

INVALID BED

BACKGROUND OF THE INVENTION

The present invention relates generally to invalid beds for invalids or bedridden persons and, more particularly, to an invalid bed with toilet equipment capable of disposing of excretions in a mechanized sanitary manner.

It is well known that some beds for invalids have a toilet opening through the mattress, under which a bedpan is placed so that the patient on the bed can discharge through the toilet opening. To dispose of the excretions, an attendant replaces the bedpan with a new one or moves the excretions into a disposable container, which is to be discarded later. In some hospitals, the bedpans are connected to a drainage so as to flush off excretions.

However, it is difficult for an ordinary home to have the afore-mentioned drainage system because of extensive work such as opening bores in the floor and placing sewers in the ground. In addition, even if such a drainage system has been built in large expenses, the bed can no longer be moved to meet later changes in layout, etc.

On the other hand, few attendants want to perform troublesome and undesirable operations such as disposal of excretions. In addition, the odor remains in the room.

SUMMARY OF THE INVENTION

Accordingly, it is an object of the invention to provide an invalid bed capable of disposing of excretions in a mechanized sanitary manner without using a costly drainage system.

According to the invention there is provided an invalid bed having a bedstead a mattress support mounted on the bedstead; a mattress placed on the mattress support and having a toilet opening, and a bedpan with a discharge port, which is movable between a retreated position and a use position immediately below the toilet opening, the invalid bed comprising a rotary table pivotally mounted on the bedstead; a plurality of containers placed on the rotary table and having an upper opening; a rotation device for rotating the rotary table so that one of the containers is disposed immediately below the discharge port; and a sealing device with a pair of pressure plates for sealing the upper opening of said container in which excretions are contained.

When the switch is depressed to operate the rotation device, the rotary table is rotated by a predetermined angle so that a container is disposed immediately below the discharge port of the bedpan. The excretions discharged by the patient on the bed fall into the container. Then, a pair of heated pressure plates of the sealing device pinch the upper edge of the container for sealing the container.

Where a plurality of containers are mounted on the rotary table at equal angular intervals, the above operation may be repeated a number of times. The actuator of the rotation device for rotating the rotary table may also be used as the actuator for operating the sealing device.

Other objects, features, and advantages of the invention will be apparent from the following description when taken in conjunction with the accompanying drawings.

DESCRIPTION OF THE PREFERRED EMBODIMENTS

Figure 1:
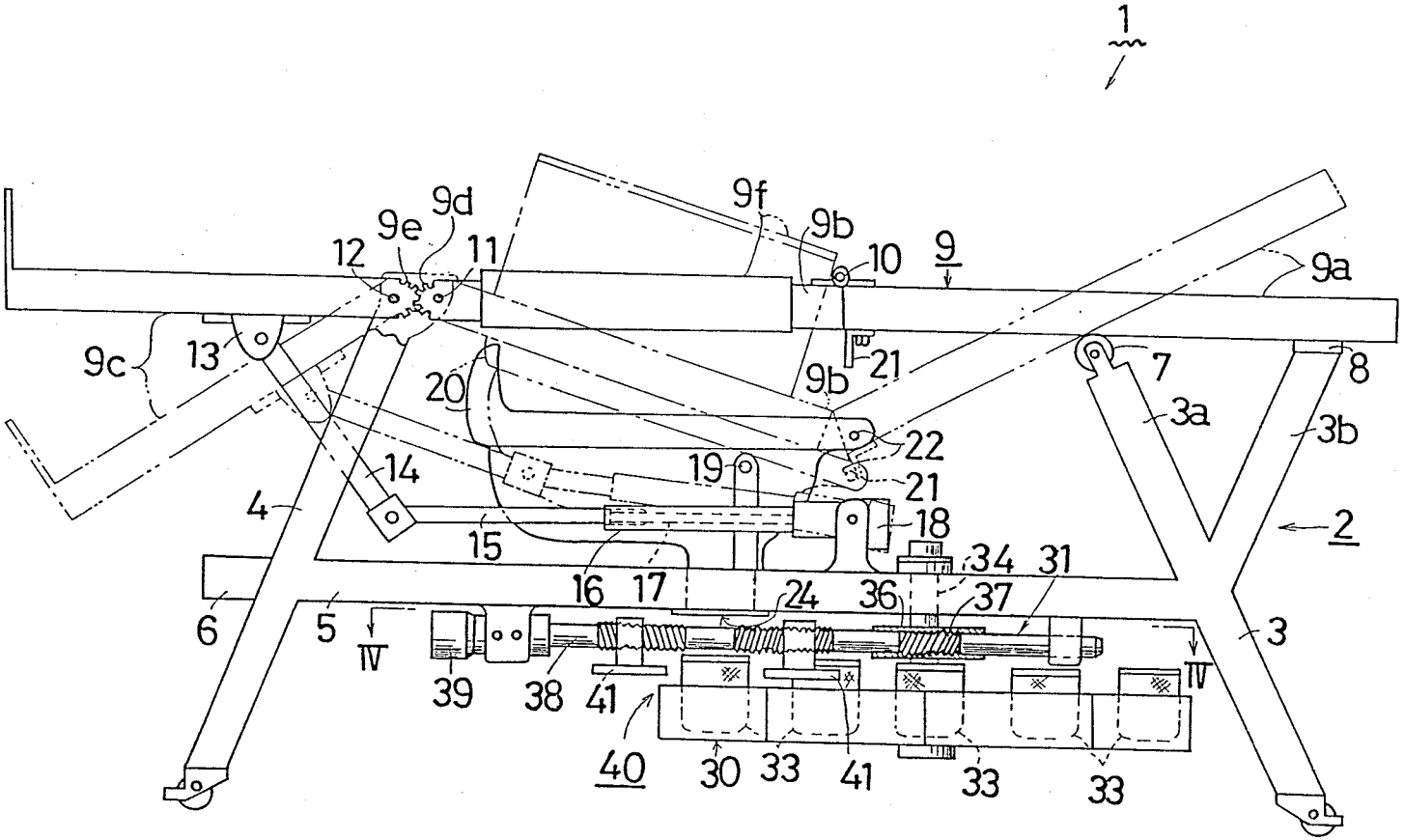
FIG. 1 is a side view of an invalid bed according to the invention.
Figure 2:
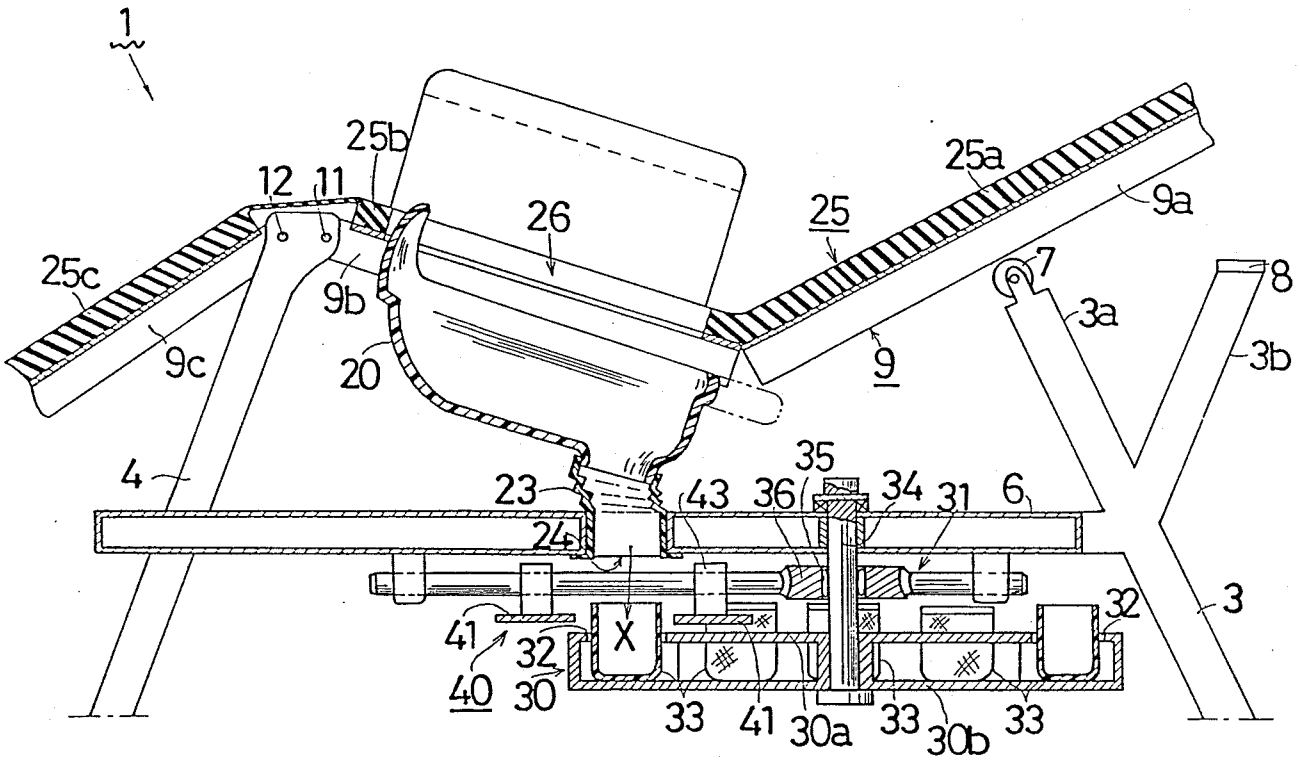
FIG. 2 is a sectional view taken along the line II—II of FIG. 3.

In FIGS. 1 and 2, the bedstead 2 of an invalid bed 1 consists of a pair of front legs 3 and a pair of rear legs 4 and a pair of side rails 5 connecting front and rear legs, and a mounting base 6 secured to the side rails. The front leg 3 is bifurcated, with a support roller 7 pivotally mounted to the end of one branch 3*a* and a stopper 8 secured to the end of the other branch 3*b*.

A mattress support 9 mounted on the bedstead 2 consists of a head section 9*a*, a seat section 9*b*, and a foot section 9*c*. The head section 9*a* and the seat section 9*b* are pivotally connected with a hinge 10 so that they may bend in the form of a V-shape. The seat section 9*b* and the foot section 9*c* are meshed with each other by means of gear ends 9*d* and 9*e* pivotally mounted on the upper end of the rear legs 4 so that they may bend in the form of a inverted V-shape.

As shown with a solid line in FIG. 1, the head section 9*a* is kept horizontal by the support roller 7 and the stopper 8. The seat section 9*b* and the foot section 9*c* are kept horizontal by a predetermined meshing position of the gear ends 9*d* and 9*e*.

A link 14 is pivotally mounted at one end on a mounting bracket 13 secured to the backside of the foot section 9*c* and articulated at the other end to one end of a tubular shaft 15 with a female screw therein. A screw shaft 17 covered by a sleeve 16 is threaded at one end into the tubular shaft 15 and secured at the other end to a motor 18. The seat section 9*b* is provided on opposite sides with a pair of arm rests 9*f* for use in the rising position. A bedpan 20 is pivoted to a pair of support posts 19 below the seat section 9*b*.

When the motor 18 rotates the screw shaft 17 to pull the tubular shaft 15 into the sleeve 16 so that the foot section 9*c* and the seat section 9*b* are bent in the form of a inverted V-shape, which in turn bends the seat section 9*b* and the head section 9*a* in the form of a V-shape as shown with a two-dot chain line in FIG. 1. When the hinged end of the head section 9*a* is lowered, a projection 21 secured to the backside of the head section 9*a* pushes downwardly a stud 22 secured to an end of the bedpan 20 so that the bedpan 20 is tilted to an angle equal to that of the seat section 9*b* and disposed immediately below the seat section 9*b*.

As best shown in FIG. 2, the lower end of the bedpan 20 communicates with a flexible pipe 23 having a discharge port 24 through the mounting base 6. The flexible pipe 23 is so flexible that when the bedpan 20 is tilted, a good communication between the bedpan 20 and the discharge port 24 is maintained. When the seat section 9b is tilted, the arm rests 9*f* are raised to the rising postion by a linkage (not shown).

Figure 3:
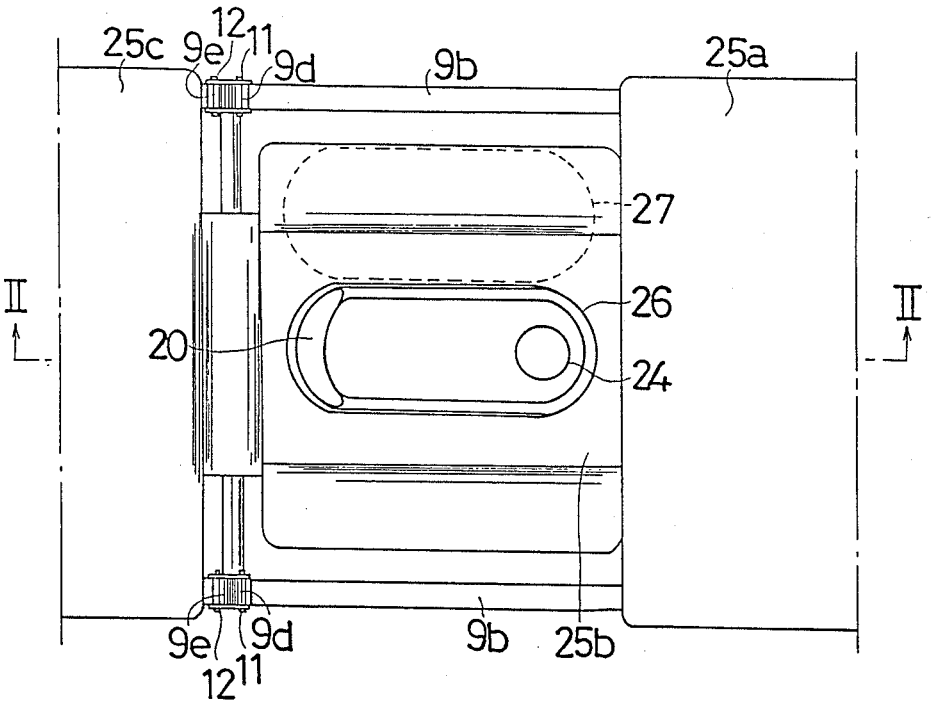
FIG. 3 is a top view of the seat section of the invalid bed of FIG. 1.

Mounted on the mattress support 9 is a mattress 25 consists of a head mattress section 25*a*, a seat mattress section 25*b*, and a foot mattress section 25*c*. The seat mattress section 25*b* has at the center a toilet opening 26 below which the bedpan 20 is disposed (FIG. 3). When the bed 1 is in the lying position as shown with the solid line in FIG. 1, the toilet opening 26 is covered with a mattress lid 27. When the bed is in the rising position as shown with the two-dot chain line, the mattress lid 27 is removed from the toilet opening 26 by an actuator (not shown). For purposes of simplicity, FIG. 1 shows no mattress on the mattress support 9.

Figure 4:
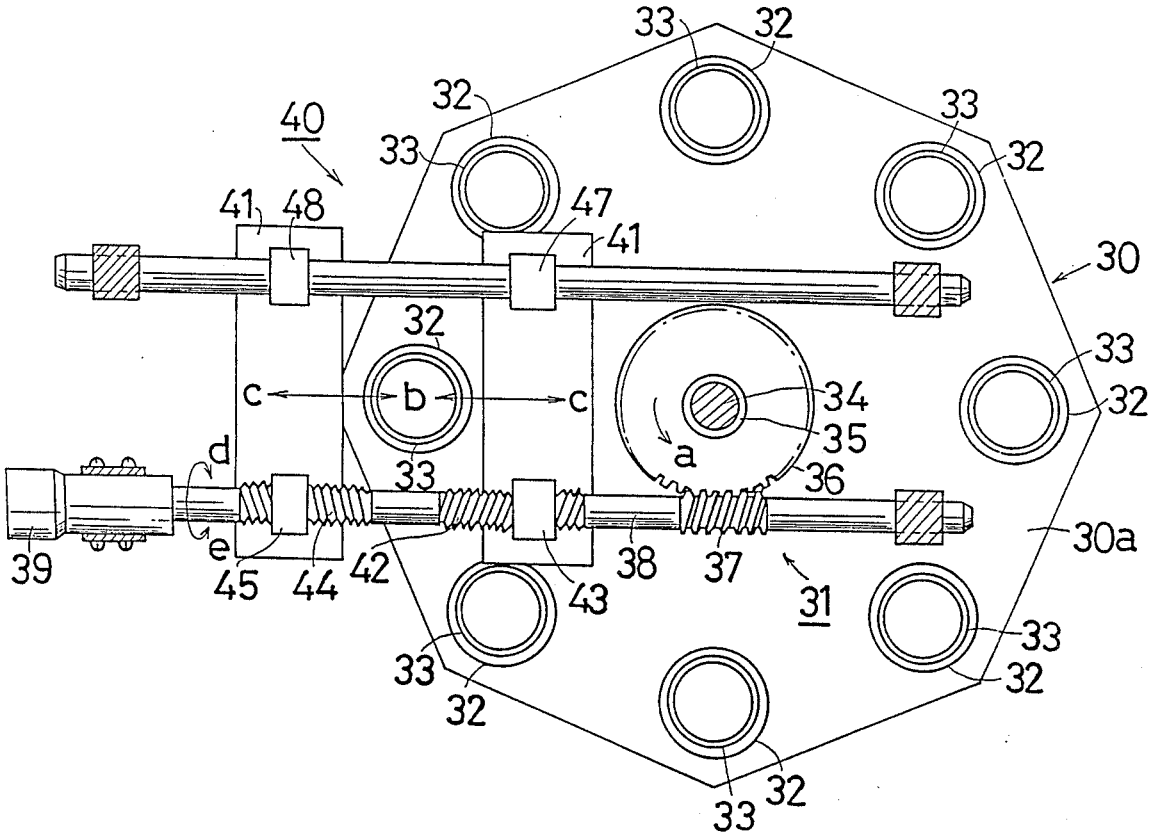
FIG. 4 is a sectional view taken along the line IV—IV of FIG. 1.

In FIGS. 2 and 4, the invalid bed 1 is provided with a rotary table 30 and a rotation device 31 for rotating the rotary table. The rotary table 30 consists of an upper octagonal plate 30*a* and a lower octagonal plate 30*b*. The upper plate 30*a* has eight openings 32 spaced at equal angular intervals or 45 degrees, into which eight containers 33 with an upper opening are placed one for each opening. However, the number of containers 33 mounted is not limited to eight as in this embodiment. The rotary table 30 is pivotally mounted on the backside of the mounting base 6 with a support shaft 34 and rotated by 45 degrees at a time in the counterclockwise direction (a) in FIG. 4 so that one of the containers 33 is always disposed below the discharge port 24 of the bedpan 20.

The rotation device 31 consists of a toothed wheel 36 connected to the support shaft 34 via a one-way clutch 35, a worm gear 37 meshed with the toothed wheel, a drive shaft 38 rotatably mounted on the mounting base 6, and an actuator 39, such as a stepping motor, for rotating the drive shaft 38 in the clockwise or counterclockwise direction. When the actuator 39 rotates the drive shaft 38 in the clockwise direction (d) as viewed from the right side in FIG. 1, the one-way clutch 35 is brought into a unlocked position, keeping the rotary table 38 stationary.

Provided above the rotary table 38 is a sealing device 40 for sealing the upper edge of a container 33. As best shown in FIG. 4, the sealing device 40 has a pair of pressure plates 41 each heated with a heater therein. The head side pressure plate 41 has at one end a nut 43 meshed with a left-handed screw 42 while the foot side pressure plate 41 has at one end a nut 45 meshed with a right-handed screw 44. The other ends of the respective pressure plates 41 are slidably mounted on a smooth shaft 46 parallel to the drive shaft 38 with sliding supports 47 and 48 respectively. When the rotary table 30 is at rest, the pressure plates 41 are disposed on opposite sides of the container 33 which is disposed immediately below the discharge port 24 of the bedpan 20. When the actuator 39 rotates in the clockwise direction (d), the pressure plates 41 are moved toward each other as shown with arrows (b).

Figure 5:
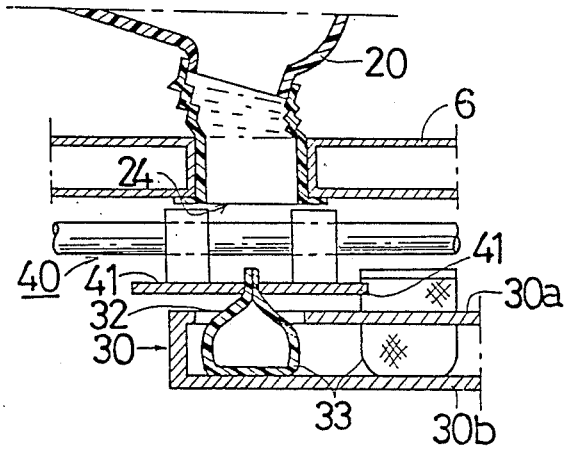
FIG. 5 is an enlarged view of essential part of FIG. 2 showing the container being sealed.

In operation, first of all, the motor 18 on the mounting base 6 is started to bend the mattress support 9 as shown in FIG. 2. After the bedpan 20 is disposed below the toilet opening 26 of the seat mattress section 25*b*, the actuator 39 of the rotation device 31 is rotated in the counterclockwise direction (e) to rotate the rotary table 30 by a predetermined angle so that one of the containers 33 is disposed below the discharge port 24 of the bedpan 20 as shown in FIG. 2. When the patient on the mattress 25 discharges through the toilet opening 26, the excretions fall through the flexible pipe 23 and the discharge port 24 into the container 33 as shown with a letter X in FIG. 2. Then, the actuator 39 is rotated in the clockwise direction (d) to move the pressure plates 4 of the sealing device 40 toward each other for sealing the upper edge of the container 33 as shown in FIG. 5. The pressure plates 41, which have been heated with heaters, seal the upper edge of the conainer 33 by pressure and/or heat.

When the drive shaft 38 is rotated in the clockwise direction (d), the pressure plates 41 are moved toward each other as shown with arrows (b) while when the drive shaft is rotated in the counterclockwise direction (e), the pressure plates are move away from each other as shown with arrows (c) and the rotary table 30 is rotated by 45 degrees in the counterclockwise direction (a) as shown in FIG. 4. After the container 33 is sealed, the pressure plates 41 are moved away from each other and the rotary table 30 is rotated by 45 degrees to put a new container 33 below the discharge port 24 so that the toilet is ready for the next use.

Alternatively, the rotary table 30 and the pressure plates 41 may be operated by separate actuators. The sealing device 40 may employ a mere pressure plates for applying pressure to the upper edge of a container, to the inside of which a glue or adhesive tape has been applied.

The invalid bed according to the invention does not need expensive plumbing and is movable, making room layout easy. In addition, excretions are disposed of in an automatic and sanitary manner, freeing attendants from undesirable and troublesome work.

While a preferred embodiment of the invention has been described using specific terms, it is to be understood that changes and variations may be made without departing from the spirit and scope of the invention as recited in the appended claims.

What is claimed is:

1. An invalid bed comprising:

a bedstead;

a mattress support mounted on said bedstead;

a mattress placed on said mattress support and having a toilet opening;

a bedpan with a discharge port, which is movable between a retreated position and a use position immediately below said toilet opening;

a rotary table pivotally mounted on said bedstead;

a plurality of containers placed on said rotary table and having an upper opening;

a rotation device for rotating said rotary table so that one of said containers is disposed immediately below said discharge port; and a sealing device with a pair of pressure plates for sealing said upper opening of said container in which excretions are contained.

* * * * *